US009443676B2

(12) United States Patent
Na

(10) Patent No.: US 9,443,676 B2
(45) Date of Patent: Sep. 13, 2016

(54) LIGHT EMITTING CONTROL KNOB

(71) Applicant: Sun-He Na, Cheonan-si (KR)

(72) Inventor: Sun-He Na, Cheonan-si (KR)

(73) Assignee: ASTEC CO., Ltd., Asan-si (KR)

( * ) Notice: Subject to any disclaimer, the term of this patent is extended or adjusted under 35 U.S.C. 154(b) by 5 days.

(21) Appl. No.: 13/819,887

(22) PCT Filed: Oct. 18, 2012

(86) PCT No.: PCT/KR2012/008544
§ 371 (c)(1),
(2) Date: Dec. 16, 2014

(87) PCT Pub. No.: WO2014/003246
PCT Pub. Date: Jan. 3, 2014

(65) Prior Publication Data

US 2015/0092387 A1 Apr. 2, 2015

(30) Foreign Application Priority Data

Jun. 27, 2012 (KR) ..... 10-2012-0068942

(51) Int. Cl.
*H01H 19/02* (2006.01)
*H01H 13/14* (2006.01)
(Continued)

(52) U.S. Cl.
CPC ..... *H01H 19/025* (2013.01); *H01H 13/023* (2013.01); *H01H 13/14* (2013.01); *H01H 19/14* (2013.01); *H01H 2219/014* (2013.01);
(Continued)

(58) Field of Classification Search
CPC ..... H01H 19/025; H01H 13/023
See application file for complete search history.

(56) References Cited

U.S. PATENT DOCUMENTS 5,036,440 A * 7/1991 Takii et al. ..... 362/95
5,820,246 A * 10/1998 Helstern ..... G01D 11/28 362/23.01

(Continued)

FOREIGN PATENT DOCUMENTS

JP 5925124 U 2/1984
JP 531042 4/1993

(Continued)

OTHER PUBLICATIONS

PCT International Search Report, PCT/KR2012/008544; Jan. 2, 2013.

(Continued)

*Primary Examiner* — Elmito Breval
(74) *Attorney, Agent, or Firm* — Westman, Champlin & Koehler, P.A.; Z. Peter Sawicki; Amanda M. Prose

(57) ABSTRACT

The present invention provides a light-emitting control knob capable of consistently maintaining a beautiful design without a problem, such as discoloration or rubbing-off, despite use of a long period because a light-blocking metal plate having light-emitting display windows formed therein is stacked and formed on a top surface of a knob body and of providing a much more beautiful and high-class design than a conventional control knob because surface processing unique to metal can be performed on the light-blocking metal plate. The light-emitting control knob in accordance with the present invention includes a knob body made of transparent or semitransparent synthetic resins which transmit light and a light-blocking metal plate formed of a metal plate stacked on a top surface of the knob body and configured to have light-emitting display windows formed therein.

6 Claims, 3 Drawing Sheets

(51) Int. Cl.
*H01H 13/02* (2006.01)
*H01H 19/14* (2006.01)

(52) U.S. Cl.
CPC .. *H01H2219/028* (2013.01); *H01H 2219/036* (2013.01); *H01H 2219/039* (2013.01); *H01H 2221/07* (2013.01); *H01H 2229/048* (2013.01); *H01H 2229/056* (2013.01)

(56) References Cited

U.S. PATENT DOCUMENTS

| | | | | |
|---|---|---|---|---|
| 5,878,870 | A * | 3/1999 | Ohtaki | H01H 13/023 200/313 |
| 7,244,898 | B2 * | 7/2007 | Kim | H01H 13/83 200/314 |
| 2005/0007764 | A1 * | 1/2005 | Reinman | 362/145 |
| 2006/0227528 | A1 * | 10/2006 | Nakamoto et al. | 362/23 |
| 2009/0107818 | A1 * | 4/2009 | Chou et al. | 200/316 |

FOREIGN PATENT DOCUMENTS

| | | | |
|---|---|---|---|
| JP | 10312726 | A | 11/1998 |
| JP | 20028476 | A | 1/2002 |
| JP | 200571728 | A | 3/2005 |
| JP | 2007-134193 | A | 5/2007 |
| JP | 2007194092 | A | 8/2007 |
| JP | 2009146642 | A | 7/2009 |
| KR | 20-2000-0002065 | U | 1/2000 |
| KR | 10-2005-0047275 | A | 5/2005 |
| KR | 1020110048123 | A | 5/2011 |

OTHER PUBLICATIONS

PCT International Written Opinion; PCT/KR2012/008544; Jan. 2, 2013.

Office Action issued for related Japanese Patent Application No. 2014-522764, dated Sep. 10, 2014.

Office Action issued for related Korean Patent Application No. 420120383661, dated Aug. 17, 2012.

Grant Decision issued for related Korean Patent Application No. 420120383661, dated Nov. 29, 2012.

* cited by examiner

LIGHT EMITTING CONTROL KNOB

CROSS-REFERENCE TO RELATED APPLICATION

This Application is a Section 371 National Stage Application of International Application No. PCT/KR2012/008544, filed Oct. 18, 2012, which claims priority to KR Application No. 10-2012-0068942, filed Jun. 27, 2012, the contents of which are hereby incorporated by reference in their entirety.

TECHNICAL FIELD

The present invention relates to a variety of control knobs applied to vehicles or electronic products, and more particularly, to a light-emitting control knob in which a light-blocking metal plate having light-emitting display windows formed therein by, for example, laser processing or CNC processing is stacked and formed on a top surface of a knob body made of synthetic resins, so the light-blocking metal plate is never discolored or rubbed off despite use of a long period, surface processing unique to metal, such as anodizing or hair processing, is made possible, and a high-class design much more beautiful than a conventional control knob in which a light-blocking layer is stacked and formed on a top surface of the knob body by way of painting or depositing can be provided.

BACKGROUND ART

In general, control knobs, for example, a display type control knob, such as a change knob on the transmission gear of a vehicle, a push type control knob, such as the start button of a vehicle, and a rotation type control knob, such as the volume control dial of audio, are applied to vehicles or electronic products in various ways.

In the control knobs, a common control knob simply made of synthetic resins is used a lot, but a light-emitting control knob for emitting light, supplied from underlying light-emitting devices, through light-emitting display windows having a character or sign form externally in order to provide a beautiful and high-class design and also increase visibility has recently been in the spotlight.

A conventional light-emitting control knob has a construction in which a light-blocking layer is stacked and formed in the remaining parts other than light-emitting display windows having a character or sign form by way of painting or depositing so that the light-emitting display windows are formed on a top surface of the knob body made of synthetic resins.

The conventional light-emitting control knob, however, is problematic in that the light-blocking layer is discolored when the control knob is used for a long period or the light-blocking layer is peeled off due to frication with a user's hand because the light-blocking layer is formed and stacked on the top surface of the knob body by way of painting or depositing. The conventional light-emitting control knob is also problematic in that a user is soon tired of the control knob because the light-blocking layer having a single color is stacked and thus the user's preference to a design part is not satisfied.

DISCLOSURE

Technical Problem

An object of the present invention is to provide a light-emitting control knob capable of consistently maintaining a beautiful design without a problem, such as discoloration or rubbing-off, despite use of a long period because a light-blocking metal plate having light-emitting display windows formed therein is stacked and formed on a top surface of a knob body.

Another object of the present invention is to provides a light-emitting control knob capable of providing a high-class design much more beautiful than a conventional control knob in which a light-blocking layer is stacked and formed on a top surface of a knob body by way of painting or depositing because surface processing unique to metal can be performed on a light-blocking metal plate.

Technical Solution

The aforementioned objects of the present invention are achieved by providing a light-emitting control knob, including a knob body made of transparent or semitransparent synthetic resins which transmit light and a light-blocking metal plate formed of a metal plate stacked on a top surface of the knob body and configured to have light-emitting display windows formed therein.

In accordance with a preferred characteristic of the present invention, the light-emitting control knob further includes light-emitting devices provided within the knob body.

In accordance with a preferred characteristic of the present invention, a light diffusion resin layer is stacked on the top surface of the knob body exposed through the light-emitting display windows.

In accordance with a preferred characteristic of the present invention, the light-blocking metal plate is stacked on the top surface of the knob body by way of adhesion or inserted injection, and the light-emitting display windows are formed by stacking the light-blocking metal plate on the top surface of the knob body and then partially cutting the light-blocking metal plate by way of laser processing or CNC processing.

In accordance with a preferred characteristic of the present invention, metal surface processing is performed on a top surface of the light-blocking metal plate.

In accordance with a preferred characteristic of the present invention, the metal surface processing performed on the top surface of the light-blocking metal plate is one of plating, deposition, anodizing, and hair line processing.

Advantageous Effects

In accordance with the light-emitting control knob according to the present invention, the light-blocking layer that forms the light-emitting display windows is not stacked and formed on a top surface of the knob body by way of painting or depositing as in the prior art, but the light-blocking metal plate in which the light-emitting display windows are formed is stacked and formed on a top surface of the knob body. Accordingly, there is an excellent advantage in that a beautiful design can be consistently maintained without a problem, such as discoloration or rubbing-off, despite use of a long period owing to the material characteristics of the metal plate.

Furthermore, in accordance with the light-emitting control knob according to the present invention, the light diffusion resin layer is stacked on a top surface of the knob body exposed through the light-emitting display windows. Accordingly, there is an excellent advantage in that visibility can be further enhanced because light can be emitted through the light-emitting display windows in a diffused state.

Furthermore, in accordance with the light-emitting control knob according to the present invention, surface processing unique to metal, such as plating, deposition, anodizing, or hair line processing, is made possible on the light-blocking metal plate. Accordingly, there is an excellent advantage in that a high-class design much more beautiful than a conventional control knob in which a light-blocking layer is stacked and formed on a top surface of the knob body by way of painting or depositing can be provided.

MODE FOR INVENTION

Preferred embodiments of the present invention will now be described in detail with reference to the accompanying drawings, but the embodiments are intended to describe the present invention in detail to the extent that those skilled in the art to which the present invention pertains may readily implement the present invention. Accordingly, the embodiments are not intended to limit the technical spirit and category of the present invention.

Figure 1:
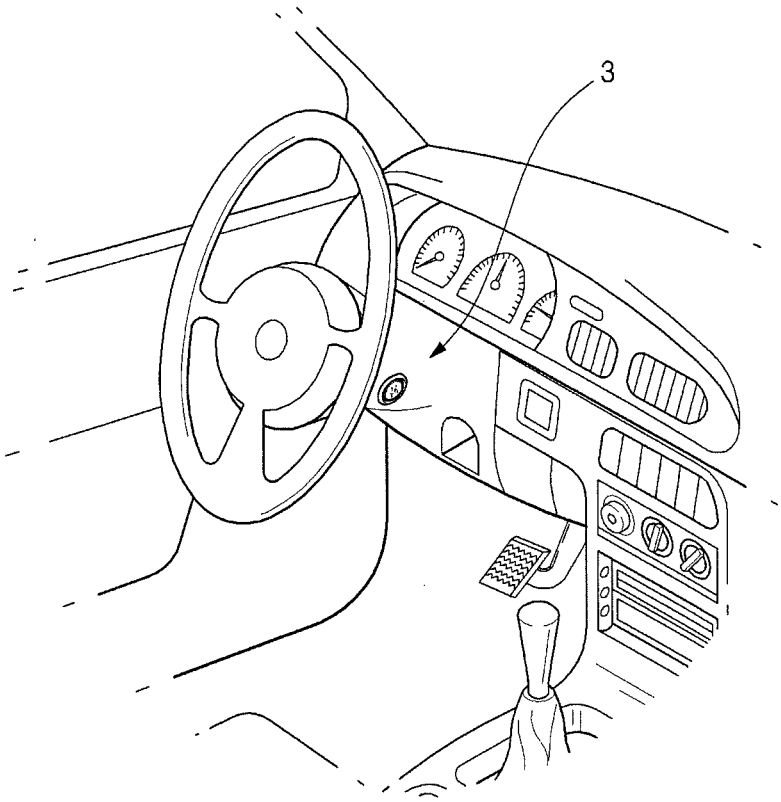
FIG. 1 is a diagram showing that the start button of a vehicle to which a light-emitting control knob in accordance with the present invention has been applied is used.
Figure 2:
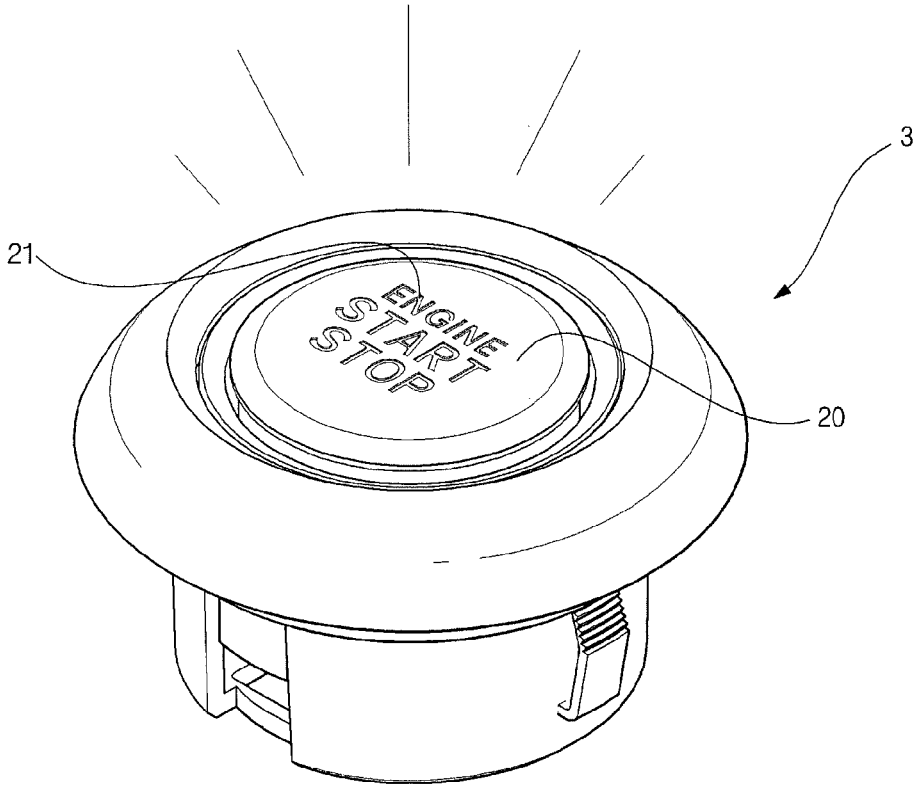
FIG. 2 is a perspective view of the start button of a vehicle to which the light-emitting control knob in accordance with the present invention has been applied.
Figure 3:
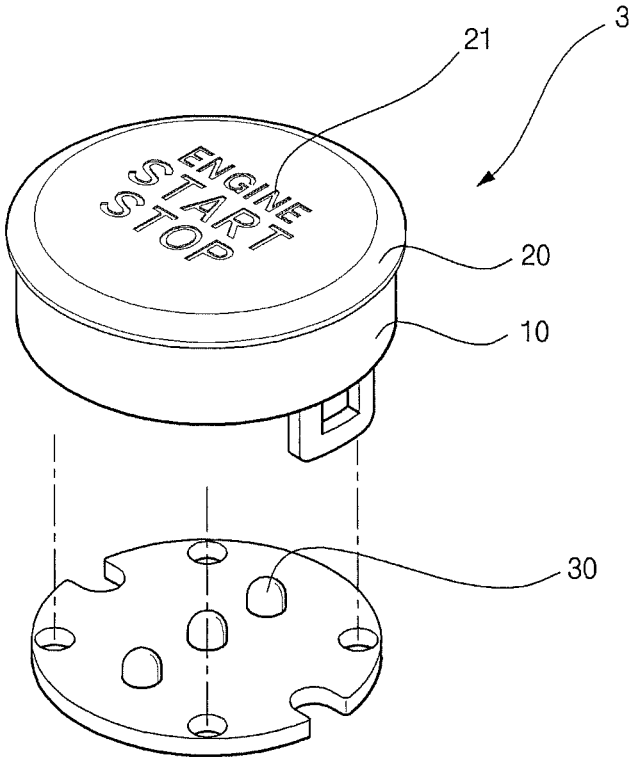
FIG. 3 an exploded perspective view of the light-emitting control knob in accordance with the present invention.

A light-emitting control knob 1 in accordance with the present invention is applied to a display type control knob, such as a change knob on the transmission gear of a vehicle, a push type control knob, such as the start button 3 of a vehicle, for example, as shown in FIGS. 1 and 2, and a rotation type control knob, such as the volume control dial of audio in vehicles or electronic products in various ways. In particular, the light-emitting control knob increases visibility by externally emitting light, supplied from an underlying light-emitting devices 30, through a light-emitting display windows 21 having a character or sign form. As shown in FIGS. 1 to 4, the light-emitting control knob includes a knob body 10 made of transparent or semitransparent synthetic resins which transmit light and a light-blocking metal plate 20 formed of a metal plate stacked on a top surface of the knob body 10 and configured to have the light-emitting display windows 21 formed therein.

Here, the knob body 10 forms the body of the light-emitting control knob 1 in accordance with the present invention, and the knob body 10 is made of transparent or semitransparent synthetic resins which can transmit light generated from the light-emitting devices 30.

The light-blocking metal plate 20 is stacked on a top surface of the aforementioned knob body 10. The light-blocking metal plate 20 forms a light-blocking surface in the remaining parts other than the light-emitting display windows 21. The light-blocking metal plate 20 is formed of a metal plate, such as a stainless steel plate or an aluminum plate. The light-emitting display windows 21 are formed in the light-blocking metal plate 20.

The light-blocking metal plate 20 may be adhered to the top surface of the knob body 10 by using an adhesive. In some embodiments, the light-blocking metal plate 20 may be integrated with the knob body 10 by way of inserted injection so that it is stacked on the top surface of the knob body 10 or may be stacked on the top surface of the knob body 10 by using various other methods, such as heating adhesion.

The light-emitting display windows 21 are display windows through which light generated from the light-emitting devices 30 is externally emitted through the transparent or semitransparent knob body 10. In general, the light-emitting display windows 21 are formed of characters or signs indicative of a function that is controlled by the light-emitting control knob 1 in accordance with the present invention. The light-emitting display windows 21 can be formed by cutting corresponding parts of the light-blocking metal plate 20 by way of laser processing or CNC processing in the state in which the light-blocking metal plate 20 has been stacked on the top surface of the knob body 10 or can be stacked on the top surface of the knob body 10 in the state in which corresponding parts of the light-blocking metal plate 20 have been cut by laser processing or CNC processing.

Figure 4:
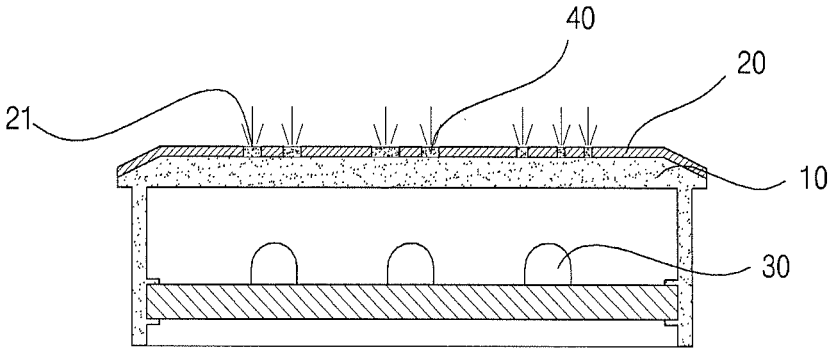
FIG. 4 is a cross-sectional view of the light-emitting control knob in accordance with the present invention.

The light-emitting devices 30 are provided within the aforementioned knob body 10. The light-emitting devices 30 preferably are formed of LED devices. The light-emitting devices 30 may be installed under the light-emitting display windows 21 within the knob body 10 so that they correspond to the light-emitting display windows 21 as shown in FIG. 4 and configured to emit light right upwardly. In some embodiments, the light-emitting devices 30 may be embedded within the knob body 10 on the side of the knob body 10 and installed to emit light toward the knob body 10.

Furthermore, a light diffusion resin layer 40 may be stacked on a top surface of the knob body 10 exposed through the light-emitting display windows 21. The light diffusion resin layer 40 functions to enhance the visibility of the light-emitting display windows 21 by further diffusing light emitted through the light-emitting display windows 21. The light diffusion resin layer 40 may be made of synthetic resins including crystal beads or may be made of synthetic resins having a light diffusion prism formed thereon.

In some embodiments, instead of the light diffusion resin layer 40, semitransparent synthetic resins having a different color from synthetic resins that form the knob body 10 may be stacked on a top surface of the knob body 10 exposed through the light-emitting display windows 21.

Furthermore, since the light-blocking metal plate 20 in itself is metal, metal surface processing, such as plating, deposition, anodizing, or hair line processing, can be performed on a top surface of the light-blocking metal plate 20. If this metal surface processing is performed, a much beautiful and high-class design can be provided.

Accordingly, in the case of the light-emitting control knob 1 in accordance with the present invention, the light-blocking layer that forms the light-emitting display windows is not stacked and formed on a top surface of the knob body by way of painting or depositing as in the prior art, but the light-blocking metal plate 20 having the light-emitting display windows 21 formed therein is stacked and formed on a top surface of the knob body 10. Accordingly, a beautiful design can be consistently maintained without a problem, such as discoloration or rubbing-off due to use of a long period, owing to the materialistic characteristic of the metal plate.

Furthermore, in the case of the light-emitting control knob 1 in accordance with the present invention, the light diffusion resin layer 40 is stacked on a top surface of the knob body 10 exposed through the light-emitting display windows 210. Accordingly, the visibility of the light-emitting display windows 21 can be further enhanced because light can be emitted through the light-emitting display windows 21 in a diffused state.

Furthermore, in the case of the light-emitting control knob 1 in accordance with the present invention, surface processing unique to metal, such as plating, deposition, anodizing, or hair line processing, can be performed on the light-blocking metal plate 20. Accordingly, a much more beautiful and high-class design than a conventional control knob in which a light-blocking layer is stacked and formed on a top surface of the knob body by way of painting or depositing can be provided.

INDUSTRIAL APPLICABILITY

The light-emitting control knob in accordance with the present invention can be applied to various forms of knobs, actuation buttons, manipulating switches used in vehicles or a variety of electrical and electronic products, as well as a change knob on the transmission gear of a vehicle, a push type control knob, such as the start button of a vehicle, and a rotation type control knob, such as the volume control dial of audio, are applied to vehicles or electronic products.

The invention claimed is:

1. A light-emitting control knob, comprising:

a knob body made of transparent or semitransparent synthetic resins which transmit light;

a light-blocking metal plate formed of a metal plate stacked on a top surface of the knob body and configured to have light-emitting display windows formed therein, wherein the light-blocking metal plate is stacked on the top surface of the knob body by way of adhesion or inserted injection, and the light-emitting display windows are formed by stacking the light-blocking metal plate on the top surface of the knob body and then partially cutting the light-blocking metal plate by way of laser processing or CNC processing;

wherein a light diffusing resin layer is stacked on the top surface of the knob body and is exposed through the light-emitting display windows; and wherein the light diffusion resin layer is made of synthetic resins where the synthetic resins include crystal beads or a light diffusion prism formed thereon.

2. The light-emitting control knob of claim 1, further comprising light-emitting devices provided within the knob body.

3. The light-emitting control knob of claim 1, wherein metal surface processing is performed on a top surface of the light-blocking metal plate.

4. The light-emitting control knob of claim 3, wherein the metal surface processing performed on the top surface of the light-blocking metal plate is one of plating, deposition, anodizing, and hair line processing.

5. The light-emitting control knob of claim 2, wherein metal surface processing is performed on a top surface of the light-blocking metal plate.

6. The light-emitting control knob of claim 1, wherein metal surface processing is performed on a top surface of the light-blocking metal plate.

* * * * *